United States Patent [19]

Clauss et al.

[11] Patent Number: 5,024,736

[45] Date of Patent: Jun. 18, 1991

[54] PROCESS FOR ELECTROPLATING UTILIZING DISUBSTITUTED ETHANE SULFONIC COMPOUNDS AS ELECTROPLATING AUXILIARIES AND ELECTROPLATING AUXILIARIES CONTAINING SAME

[75] Inventors: Wolfgang Clauss, Neustadt; Werner Kurze, Neuhofen; Ferdinand Leifeld, Ludwigshafen; Willy Wassenberg, Neuhofen, all of Fed. Rep. of Germany

[73] Assignee: Raschig AG, Ludwigshafen, Fed. Rep. of Germany

[21] Appl. No.: 357,044

[22] Filed: May 24, 1989

[30] Foreign Application Priority Data

May 25, 1988 [DE] Fed. Rep. of Germany ..... 3817722

[51] Int. Cl.[5] ..... C25D 3/12; C25D 3/38; C07D 213/00

[52] U.S. Cl. ..... 204/49; 204/52.1; 546/139; 546/152; 546/339; 562/108; 562/110

[58] Field of Search ..... 204/49, 52.1; 562/108, 562/110; 546/139, 152, 339

[56] References Cited

U.S. PATENT DOCUMENTS

| | | | |
|---|---|---|---|
| 2,876,177 | 3/1959 | Gündel et al. | 204/49 |
| 3,314,868 | 4/1967 | Willmund et al. | 204/49 |
| 3,328,273 | 6/1967 | Creutz et al. | 204/52.1 |
| 3,376,308 | 4/1968 | Gündel | 204/52.1 X |

FOREIGN PATENT DOCUMENTS

| | | |
|---|---|---|
| 86481 | 11/1958 | Denmark . |
| 1092744 | 11/1960 | Fed. Rep. of Germany . |

OTHER PUBLICATIONS

Chemical Abstracts, vol. 102, 4534v, 1985, "Canadian Journal of Chemistry".

*Primary Examiner*—G. L. Kaplan
*Attorney, Agent, or Firm*—Collard, Roe & Galgano

[57] ABSTRACT

A process in which disubstituted ethane sulfonic compounds are employed as electroplating auxiliaries in electroplating. The compounds for use in combination with the claimed process have the general formula:

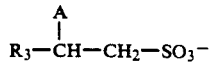

wherein,

A represents a pyridinium radical

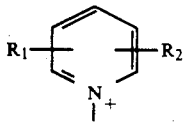

in which $R_1$ and $R_2$ denote hydrogen or an alkyl radical having 1 to 3 carbon atoms, or $R_1$ and $R_2$, together with the pyridinium radical, form a condensed six-membered aromatic ring; or, A represents a mercapto radical of the formula —S—$R_4$, in which $R_4$ denotes hydrogen or the group:

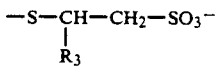

and $R_3$ is an alkyl group having 1 to 4 carbon atoms.

Also included within the scope of the present invention are alkali or ammonium salts of the compounds of the foregoing structural formula.

3 Claims, No Drawings

PROCESS FOR ELECTROPLATING UTILIZING DISUBSTITUTED ETHANE SULFONIC COMPOUNDS AS ELECTROPLATING AUXILIARIES AND ELECTROPLATING AUXILIARIES CONTAINING SAME

The present invention relates to electroplating auxiliaries and a process for electroplating utilizing disubstituted ethane sulfone compounds.

The foregoing compounds, for use in combination with the present invention as electroplating auxiliaries, have the general formula (I):

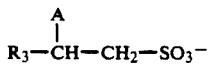

(I)

wherein,

Represents a pyridinium radical

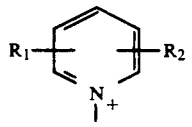

in which $R_1$ and $R_2$ denote hydrogen or an alkyl radical having 1 to 3 carbon atoms, or $R_1$ and $R_2$, together with the pyridinium radical, form a condensed six-membered aromatic ring; or, represents a mercapto radical of the formula - S - $R_4$, in which $R_4$ denotes hydrogen or the group:

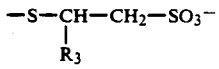

and $R_3$ is an alkyl group having 1 to 4 carbon atoms.

Also included within the scope of the present invention are alkali or ammonium salts of the compounds of Formual (I).

Some of the compounds disclosed by Formula (I) in which A is a pyridinium radical and $R_3$ is $CH_3$ (*Can. J. Chem.*, 62:19, 1977–95 (1984)) are knwon to arts unrelated to the art of electroplating technology and $R_3$=n—$C_4H_9$. (*J. Am. Chem. Soc.* 76, 3945 (1954)).

Additionally, propane sulfonic compounds, with a pyridinium substituent and/or a quinoline substituent in position 3, are known and used for electroplating purposes as brighteners or levelling agents in acid nickel baths (cf. West German Patent No. 1 004 011). Surprisingly, the disubstituted ethane sulfonic compounds according to the invention, with an alkyl chain branched at C2, possess good brightening and levelling properties, particularly in nickel and copper platings, notwithstanding the fact that poor results might be anticipated due to the steric hindrance. Thus, numerous substance variants permit adaptation and optimization to varied electroplating requirements.

The production of the foregoing compounds of Formula (I) for use in combination with the invention is accomplished by simultaneously reacting compounds AH or A with an olefin, of the formula $R_3$—CH=$CH_2$, with sulfur trioxide in an inert solvent and/or mixture of solvents, or by sulfonation of the olefin mixed with dioxane in a falling-film reactor and allowing the 1,2-sulfone so obtained to react with compound AH or A.

Pyridine and quinoline derivaties of the disubstituted ethano sulfone betaines were found to be particularly effective brighteners and levelling agents in acid nickel baths, whereas the mercapto derivatives are suitable as brighteners in acid copper baths.

The present invention will now be described in greater detail with reference being made to the following examples. It should, however, be recognized that the following examples are provided for purposes of illustration only and are not intended as defining the scope of the invention.

EXAMPLE 1

An electroplating nickel bath was set up as follows:

50 g/l: boric acid
70 g/l: nickel chloride 6 $H_2O$
330 g/l: nickel sulfate 7 $H_2O$
2 g/l: saccharin
0.2 g/l: test compound
0.02 g/l: levelling agent (epichloro hydrin propargyl alcohol adduct)

and brought up to 1 liter with distilled water and adjusted to a pH of 4.0 with sulfuric acid.

A brass plate was nickel-plated in a 'Hull Cell' for 10 minutes at the rate of 2 A per sq. decimeter at 60° C. The plate had been previously immersed in alkaline solution, rinsed with water and cathodically degreased at 2.5 A for 2 minutes. Next, the plates were rinsed with water, immersed for 30 seconds in a pickling grease remover, rubbed off with cellulose and once again rinsed with water. The bath was stirred by a stream of air bubbles.

As an example, the following test compounds were used:

(a) 1-(2-sulfopropyl)-pyridinium betaine, and
(b) 1-(2-sulfopentyl)-pyridinium betaine.

After nickelplating, the plates exhibited a homogeneous, bright and smooth surface. Storage stability of the additive solution at 60° C. was good.

EXAMPLE 2

A bath was utilized consisting of 22.5 g/l: copper in the form of its sulfate
185 g/l: sulfuric acid, and
75 mg/l: chloride (in the form of hydrochloric acid) as well as
8 ml/l: non-ionic wetting agent (of the type of polyglycol).

To this increasing concentrations of sodium-2-mercaptopropane-1-sulfonate were added. A test cell having a 1.5-liter bath content was used. The copper plates used in the test were dull and angulated. They were moved perpendicular to the anode at the rate of 0.8 m per minute (3-cm stroke). Copper plating was performed at a cathodic current density of 3 A per sq. decimeter for 30 minutes at 25° C. The cathode was an angled copper plate.

The compound yielded very good brightness at a concentration of 0.2 to 0.4 mg/l.

While only several examples of the present invention have been described, it will be obvious to those of ordinary skill in the art that many modifications may be made to the present invention without departing from the spirit and scope thereof.

What is claimed is:

1. A brightener for acid electroplating copper baths comprising a compound of the formula $$R_3-\overset{\overset{\displaystyle A}{|}}{C}H-CH_2-SO_3^-$$

or an alkali or an ammonium salt thereof, wherein,

A represents a mercapto radical of the formula - S - $R_4$, in which $R_4$ is hydrogen and $R_3$ represents an alkyl group having 1 to 4 carbon atoms.

2. A process for electroplating, comprising the step of:

adding to a nickel electroplating bath, a compound of the formula $$R_3-\overset{\overset{\displaystyle A}{|}}{C}H-CH_2-SO_3^-$$

or an alkali or an ammonium salt thereof, wherein,

A represents a mercapto radical of the formula -S-$R_4$, in which $R_4$ denotes a substituent selected from the group consisting of hydrogen and the group:

$$-S-\underset{\underset{\displaystyle R_3}{|}}{C}H-CH_2-SO_3^-$$

$R_3$ represents an alkyl group having 1 to 4 carbon atoms said compound, or said alkali salt or said ammonium salt thereof, being an electroplating auxiliary.

3. A process for electroplating, comprising the step of:

adding to a copper electroplating bath, a compound of the formula $$R_3-\overset{\overset{\displaystyle A}{|}}{C}H-CH_2-SO_3^-$$

or an alkali or an ammonium salt thereof, wherein,

A represents a pyridinium radical

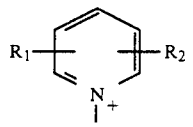

in which $R_1$ and $R_2$ independently denote hydrogen or an alkyl radical having 1 to 3 carbon atoms, $R_1$ and $R_2$ together with a pyridinium radical form a condensed six-membered aromatic ring, $R_3$ represents an alkyl group having 1 to 4 carbon atoms said compound, or said alkali salt or said ammonium salt thereof, being an electroplating auxiliary.

* * * * *